US008667934B1

(12) United States Patent
Woo et al.

(10) Patent No.: US 8,667,934 B1
(45) Date of Patent: Mar. 11, 2014

(54) ENGINE HAVING COMPRESSION RATIO VARIABLE DEVICE

(71) Applicant: Hyundai Motor Company, Seoul (KR)

(72) Inventors: Yoonsik Woo, Yongin-si (KR); Jin Kook Kong, Suwon-si (KR); Dong Seok Lee, Suwon-si (KR); Eun Ho Lee, Suwon-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/725,372

(22) Filed: Dec. 21, 2012

(51) Int. Cl.
*F02B 75/04* (2006.01)

(52) U.S. Cl.
USPC ..... 123/78 BA; 123/48 B

(58) Field of Classification Search
USPC ..... 123/48 B, 48 AA, 78 A, 78 B, 78 BA
See application file for complete search history.

(56) References Cited

U.S. PATENT DOCUMENTS 7,721,688 B2 * 5/2010 Kamiyama ..... 123/78 R
2012/0145128 A1 * 6/2012 Tateno ..... 123/48 B

FOREIGN PATENT DOCUMENTS

JP 2004150353 A * 5/2004 ..... F02D 15/04
JP 2009041507 A * 2/2009

* cited by examiner

*Primary Examiner* — Hung Q Nguyen

(74) *Attorney, Agent, or Firm* — Morgan, Lewis & Bockius LLP

(57) ABSTRACT

An engine may include a crankshaft, a piston, a connecting rod that connects a crank pin of the crankshaft with the piston, and a compression ratio variable device that varies a distance between the piston and the crank pin, wherein the compress ratio variable device includes: a block cover mounted on an outside of the engine block and a cover journal portion and a worm wheel mounting space are formed therein, a control shaft contacting the cover journal portion and an operating arm protruding from an exterior circumference of the control shaft, and a motor portion, wherein a worm connected to the motor portion is mounted to the block cover, the worm being engaged with the worm wheel so as to rotate the control shaft according to the motor portion, wherein a distance between the piston and the crank pin is varied by a rotation of the control shaft.

9 Claims, 4 Drawing Sheets

ENGINE HAVING COMPRESSION RATIO VARIABLE DEVICE

CROSS-REFERENCE TO RELATED APPLICATION

The present application claims priority to Korean Patent Application No. 10-2012-0122088 filed on Oct. 31, 2012, the entire contents of which is incorporated herein for all purposes by this reference.

BACKGROUND OF THE INVENTION

1. Field of the Invention

The present invention relates to an engine having a compression ratio variable device and varies a compression ratio of a combustion chamber depending on the operating condition of an engine to improve the combustion efficiency and reduce the noise/vibration.

2. Description of Related Art

Generally, if the compression ratio is increased, the heat efficiency of engine is improved, and if the ignition timing is advanced to a predetermined level in an ignition type engine, the heat efficiency is increased.

However, if the ignition timing is advanced in a high compression ratio, the fuel is abnormally combusted in a cylinder to damage the engine, and therefore there is a limit in advancing the ignition timing and the output power can be deteriorated thereby.

A variable compression ratio (VCR) device varies the compression ratio of air/fuel mixture in a cylinder depending on the driving condition of an engine.

In an engine having a compression ratio variable device, the compression ratio of the air/fuel mixture is increased in a low load condition of an engine to improve the fuel consumption efficiency, and the compression ratio of the air/fuel mixture is decreased in a high load condition of an engine to prevent the knocking and improve the output of the engine.

The engine having a conventional compression ratio variable device varies the length between a piston and a crank pin that connect the piston with a crankshaft to vary the compression ratio.

The engine having the above type of compression ratio variable device includes a control shaft, a shaft cap, a block cover, and a control motor, wherein the control motor rotates the control shaft and an operating arm that is disposed on the control shaft rotates an eccentric bearing through a link structure.

Meanwhile, a shaft cap is to be used to fix the control shaft on an engine block and a block cover covers the shaft cap and the control shaft, and therefore the number of the components and the weight thereof has to be increased. Further, a control motor as an actuator is disposed at one end portion of the block cover, and therefore the layout volume is increased and the driving torque of the control motor is not effectively transferred to the control shaft.

The information disclosed in this Background of the invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine having a compression ratio variable device having advantages of making the structure of a block cover and a shaft cap simple, reducing the number of components and weight, decreasing the layout volume of a control motor as an actuator, and effectively transferring the driving torque of a control motor to a control shaft.

In an aspect of the present invention, an engine that may have a compression ratio variable device may include a crankshaft that is rotatably disposed on an engine block and a crank pin is disposed therein, a piston that reciprocates in a cylinder of the engine block, a connecting rod that connects the crank pin of the crankshaft with the piston, and the compression ratio variable device that varies a distance between the piston and the crank pin, wherein the compress ratio variable device may include a block cover that is mounted on an outside of the engine block and a cover journal portion and a worm wheel mounting space are formed therein, a control shaft of which an exterior circumference contacts the cover journal portion to be rotatably supported by the cover journal portion and in which a worm wheel is disposed on one side thereof, and an operating arm protrudes from an exterior circumference of the control shaft, and a motor portion that is disposed at an outside of the block cover, wherein a worm connected to the motor portion is mounted to the block cover by penetrating the block cover, the worm being engaged with the worm wheel so as to rotate the control shaft according to the motor portion, wherein a distance between the piston and the crank pin is varied by a rotation of the control shaft.

The compress ratio variable device may include an eccentricity bearing that is interposed between the piston and a piston pin that connects the piston and the connecting rod, and an eccentricity link that connects a one end of the operating arm with the eccentricity bearing.

The eccentricity link may include a first link of which one end thereof is connected to the one end of the operating arm, and a second link of which one end thereof is connected to the eccentricity bearing and the other end of which is connected to the other end of the first link.

A plurality of operating arms is formed on the control shaft at a predetermined distance from each other in a length direction and the worm wheel is disposed between the operating arms.

The control shaft is disposed in parallel to the crankshaft and is rotatably disposed between the engine block and the block cover.

A shaft journal portion is formed on the control shaft between the operating arms and the shaft journal portion contacts a cover journal portion formed in the block cover.

An operating arm mounting space is formed in the block cover to receive the operating arms therein.

The worm wheel mounting space is formed in the block cover to receive the worm wheel.

A worm mounting hole is formed in the block cover to receive the worm and communicates with the worm wheel mounting space.

In an engine having a compression ratio variable device according to an exemplary embodiment of the present invention, a separate cap is not disposed to fix a control shaft on an engine block, the block cover is mounted on the engine block and simultaneously the control shaft is fixed on the engine block by the block cover, and therefore overall weight and the number of components are reduced, the layout becomes small, and assembly process is saved.

Further, a motor portion is disposed at a central portion of an outside of the block cover, and therefore overall layout is reduced and the torque of the motor portion is effectively transferred to the control shaft.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
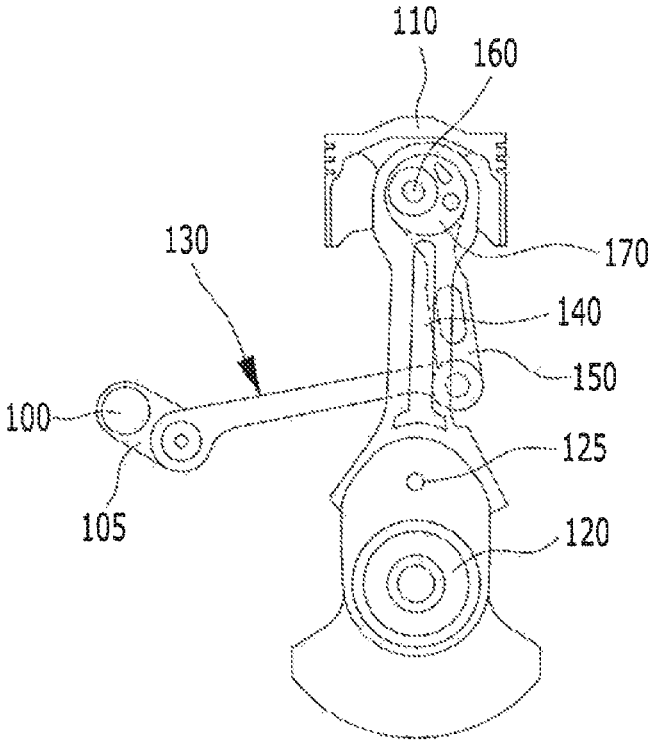
FIG. 1 is a partial side view showing an engine having a compression ratio variable device according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a partial side view showing an engine having a compression ratio variable device according to an exemplary embodiment of the present invention.

Referring to FIG. 1, an engine having a compression ratio variable device includes a crankshaft 120, a connecting rod 140, an eccentricity bearing 170, a piston pin 160, a piston 110, a control shaft 100, an operating arm 105, a first link 130, and a second link 150.

A lower end portion of the connecting rod 140 is connected to a crank pin 125 that is disposed on the crankshaft 120 and an upper end portion of the connecting road 140 is connected to the piston 110 through the piston pin 160.

And, the eccentricity bearing 170 is interposed between the piston pin 160 and an interior circumference of a hole that is formed at an upper end portion of the connecting rod 140. That is, the eccentricity bearing 170 is rotatably disposed between the connecting rod 140 and the piston pin 160.

The distance between the piston 110 and the crank pin is varied by the rotation of the eccentricity bearing 170 to vary the compression ratio of the engine.

The control shaft 100 is rotatably disposed in parallel to the crankshaft 120, and the operating arm 105 protrudes outwardly on the control shaft 100.

One end portion of the first link 130 is connected to one end of the operating arm 105, and one end portion of the second link 150 is connected to the other end portion of the first link 130. Further, the other end portion of the second link 150 is connected to the eccentricity bearing 170.

Here, the operating arm 105 and the first link 130 are connected by a hinge pin, and the first link 130 and the second link 150 are connected by a hinge pin. And, the eccentricity bearing 170 is fixed on the second link 150 such that the second link 150 can rotate the eccentricity hearing 170.

If the control shaft 100 is rotated, the operating arm 105 pushes or draws the first link 130 and the second link 150 rotates the eccentricity bearing 170 in a clockwise direction or in an anti-clockwise direction.

Figure 2:
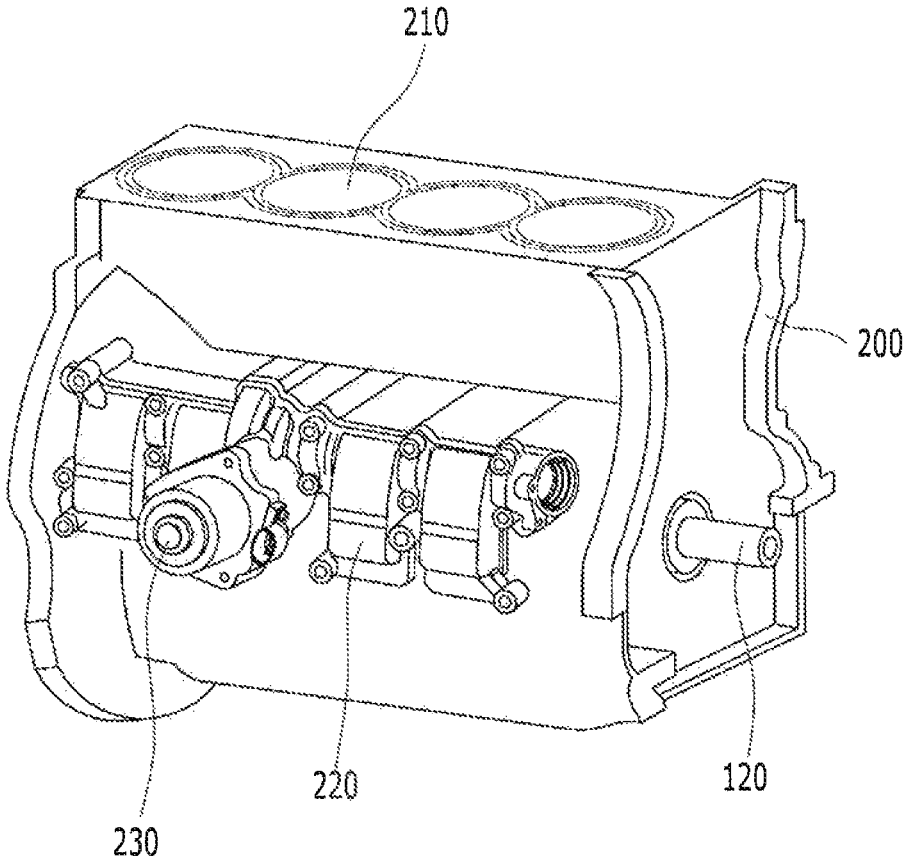
FIG. 2 is a partial perspective view of an engine having a compression ratio variable device according to an exemplary embodiment of the present invention.

FIG. 2 is a partial perspective view of an engine having a compression ratio variable device according to an exemplary embodiment of the present invention.

Referring to FIG. 2, an engine includes an engine block 200 having a cylinder, a crankshaft 120 that is disposed at a lower side of the cylinder 210, a block cover 220 that is mounted at a side of the engine block 200, and a motor portion 230 that is disposed at an outside of the block cover 220. The block cover 220 can be mounted on the engine block 200.

In an exemplary embodiment of the present invention, the output torque of the motor portion 230 is used to rotate the control shaft 100 in a clockwise or in an anti-clock wise direction.

Further, the control shaft 100 is rotatably interposed between an interior surface of the block cover 220 and an outside surface of the engine block 200. That is, the control shaft 100 is rotatably disposed on the engine block 200 by the block cover 220.

Figure 3:
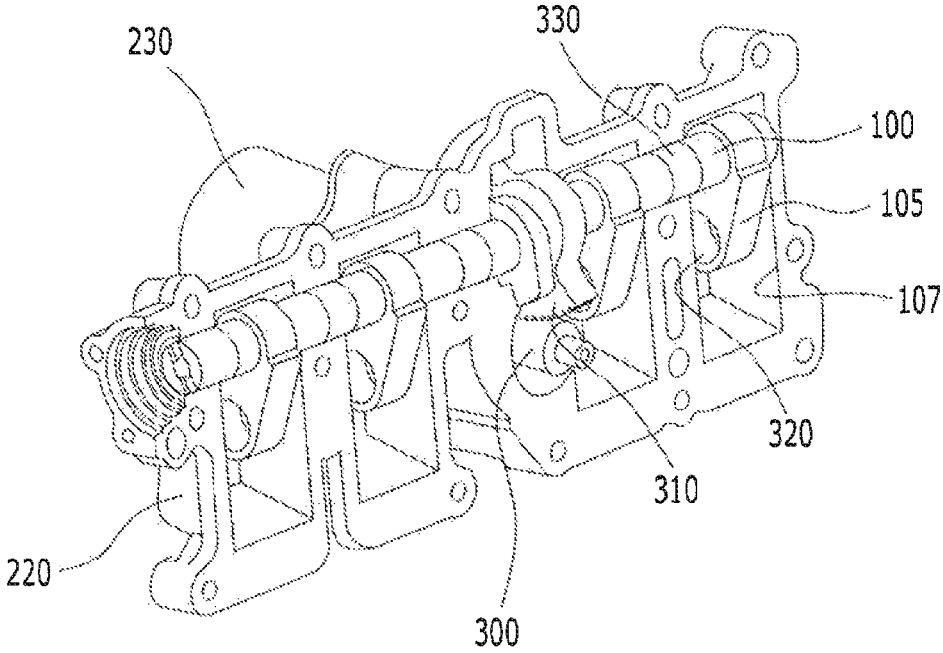
FIG. 3 is a partial exploded perspective view of an engine having a compression ratio variable device according to an exemplary embodiment of the present invention.
Figure 4:
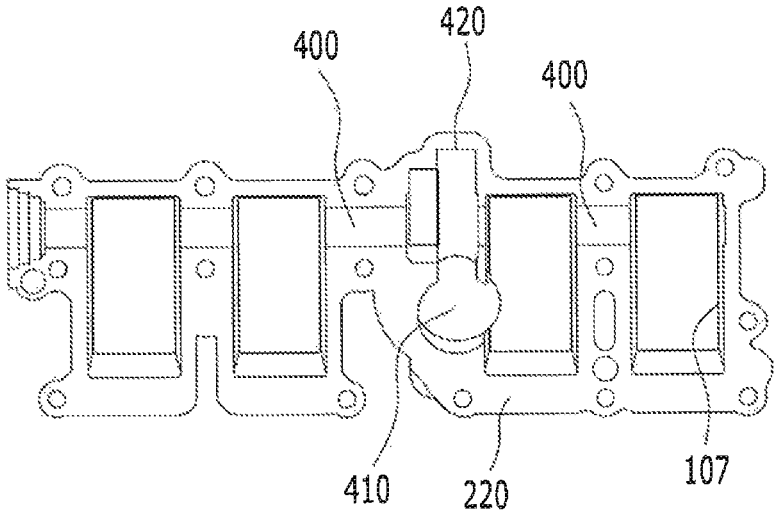
FIG. 4 is a side view showing an interior surface of a block cover that is prepared on an engine according to an exemplary embodiment of the present invention.

FIG. 3 is a partial exploded perspective view of an engine having a compression ratio variable device according to an exemplary embodiment of the present invention, and FIG. 4 is a side view showing an interior surface of a block cover that is prepared on an engine according to an exemplary embodiment of the present invention.

Referring to FIG. 3 and FIG. 4, an engine having a compression ratio variable device includes a block cover 220, a control shaft 100, an operating arm 105, a worm wheel 310, a worm 300, and a motor portion 230.

The operating arm 105 outwardly protrudes on the control shaft 100, and the operating arms 105 are arranged at a predetermined distance in a length direction of the control shaft 100. And, a pin hole 320 through which a hinge pin is inserted is formed at a front end portion of the operating arm 105.

A shaft journal portion 330 is formed on an exterior circumference of the control shaft between the operating arms 105, and a cover journal portion 400 is formed at an interior surface of the block cover 220 corresponding to the shaft journal portion 330.

In an exemplary embodiment of the present invention, an operating arm mounting space 107 is formed at an interior surface of the block cover 220 corresponding to the operating arm 105.

The cover journal portion 400 contacts the shaft journal portion 330 through a sliding surface, and the cover journal portion 400 of the block cover 220 rotatably fixes the control shaft 100 on the engine block 200.

Further, a worm wheel 310 is formed on the control shaft 100 between the operating arms 105 and the worm 300 is engaged with the worm wheel 310.

The motor portion 230 is disposed at a central portion of an outside of the block cover 220, and the worm 300 that is inserted into the worm mounting hole 410 of the block cover 220 is disposed at a front end portion of the motor portion 230.

The worm 300 is rotated by a motor that is disposed in the motor portion 230, and the worm 300 rotates the control shaft 100 through the worm wheel 310.

As described above, a worm mounting hole 410 that the worm is inserted is formed in the block cover 220, and a worm wheel mounting space 420 is formed on the block cover 220 corresponding to the worm mounting hole 410.

As described above, a separate cap is not disposed to fix the control shaft 100 on the engine block 200 in an exemplary embodiment of the present invention.

And, the block cover 220 that is mounted on the engine block 200 fixes the control shaft 100 on the block cover 220, and therefore overall weight is reduced, the layout is simple, and the assembly process is reduced.

Further, the motor portion 230 is disposed at a central portion of an outside of the block cover 220, and therefore overall layout is reduced and the motor portion 230 can effectively transfers the torque to the control shaft 100.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine that has a compression ratio variable device, comprising:

a crankshaft that is rotatably disposed on an engine block and a crank pin is disposed therein;

a piston that reciprocates in a cylinder of the engine block;

a connecting rod that connects the crank pin of the crankshaft with the piston; and the compression ratio variable device that varies a distance between the piston and the crank pin, wherein the compress ratio variable device includes:

a block cover that is mounted on an outside of the engine block and a cover journal portion and a worm wheel mounting space are formed therein;

a control shaft of which an exterior circumference contacts the cover journal portion to be rotatably supported by the cover journal portion and in which a worm wheel is disposed on one side thereof, and an operating arm protrudes from an exterior circumference of the control shaft; and a motor portion that is disposed at an outside of the block cover, wherein a worm connected to the motor portion is mounted to the block cover by penetrating the block cover, the worm being engaged with the worm wheel so as to rotate the control shaft according to the motor portion, wherein a distance between the piston and the crank pin is varied by a rotation of the control shaft.

2. The engine that has the compression ratio variable device of claim 1, wherein the compress ratio variable device includes:

an eccentricity bearing that is interposed between the piston and a piston pin that connects the piston and the connecting rod; and an eccentricity link that connects a one end of the operating arm with the eccentricity bearing.

3. The engine that has the compression ratio variable device of claim 2, wherein the eccentricity link includes:

a first link of which one end thereof is connected to the one end of the operating arm; and a second link of which one end thereof is connected to the eccentricity bearing and the other end of which is connected to the other end of the first link.

4. The engine that has the compression ratio variable device of claim 2, wherein a plurality of operating arms is formed on the control shaft at a predetermined distance from each other in a length direction and the worm wheel is disposed between the operating arms.

5. The engine that has the compression ratio variable device of claim 4, wherein the control shaft is disposed in parallel to the crankshaft and is rotatably disposed between the engine block and the block cover.

6. The engine that has the compression ratio variable device of claim 4, wherein a shaft journal portion is formed on the control shaft between the operating arms and the shaft journal portion contacts the cover journal portion formed in the block cover.

7. The engine that has the compression ratio variable device of claim 4, wherein an operating arm mounting space is formed in the block cover to receive the operating arms therein.

8. The engine that has the compression ratio variable device of claim 4, wherein the worm wheel mounting space is formed in the block cover to receive the worm wheel.

9. The engine that has the compression ratio variable device of claim 8, wherein a worm mounting hole is formed in the block cover to receive the worm and communicates with the worm wheel mounting space.

* * * * *